US007935402B2

(12) United States Patent
Cole et al.

(10) Patent No.: US 7,935,402 B2
(45) Date of Patent: May 3, 2011

(54) OPHTHALMIC BLOCKING PAD

(75) Inventors: Todd W. Cole, Dracut, MA (US); Donald J. Therriault, York, PA (US)

(73) Assignee: Saint-Gobain Performance Plastics Corporation, Aurora, OH (US)

( * ) Notice: Subject to any disclaimer, the term of this patent is extended or adjusted under 35 U.S.C. 154(b) by 546 days.

(21) Appl. No.: 11/743,733

(22) Filed: May 3, 2007

(65) Prior Publication Data

US 2008/0274672 A1 Nov. 6, 2008

(51) Int. Cl.
*B32B 33/00* (2006.01)
*B24B 13/005* (2006.01)

(52) U.S. Cl. ..... 428/40.1; 451/41; 451/390; 428/317.3; 428/343; 428/354; 428/423.1; 428/423.7

(58) Field of Classification Search ..... 451/324, 451/390, 460, 41, 42, 43, 44, 384, 921, 388, 451/398; 428/40.1, 40.2, 41.3, 41.5, 41.6, 428/41.7, 41.8, 41.9, 42.1, 42.2, 317.3, 343, 428/354, 423.1, 423.7, 71, 158, 160; 424/78.04
See application file for complete search history.

(56) References Cited

U.S. PATENT DOCUMENTS

| | | | | |
|---|---|---|---|---|
| 4,019,285 | A | | 4/1977 | Gravell |
| 4,221,083 | A | | 9/1980 | Carroll |
| 4,287,013 | A | | 9/1981 | Ronning |
| 4,291,508 | A | | 9/1981 | Prunier |
| RE31,897 | E | | 5/1985 | Johnson |
| 4,925,518 | A | | 5/1990 | Wasserman et al. |
| 5,649,856 | A | | 7/1997 | Cook |
| 5,716,701 | A | | 2/1998 | Skoglund et al. |
| 5,743,981 | A | | 4/1998 | Lu |
| 5,749,968 | A | | 5/1998 | Melanson et al. |
| 5,763,075 | A | | 6/1998 | Benjamin et al. |
| 5,792,537 | A | | 8/1998 | Ohlin, Jr. |
| 5,827,390 | A | | 10/1998 | Benjamin et al. |
| 5,885,700 | A | | 3/1999 | Weldon et al. |
| 5,916,017 | A | | 6/1999 | Sedlock |
| 5,945,462 | A | | 8/1999 | Salamon |
| 6,001,471 | A | * | 12/1999 | Bries et al. ..... 428/40.1 |
| 6,036,313 | A | | 3/2000 | Benjamin et al. |
| 6,074,290 | A | | 6/2000 | Ko et al. |
| 6,250,512 | B1 | | 6/2001 | Salamon |
| 6,350,397 | B1 | | 2/2002 | Beikkila et al. |

(Continued)

FOREIGN PATENT DOCUMENTS

| | | |
|---|---|---|
| EP | 0615814 | 9/1994 |

(Continued)

OTHER PUBLICATIONS

DURO-TAK AH115-80-115A, Acrylic Hybrid Pressure Sensitive Adhesive, National Adhesives, A National Starch & Chemical Business, 2005.

(Continued)

*Primary Examiner* — Alicia Chevalier
*Assistant Examiner* — Walter Moore
(74) *Attorney, Agent, or Firm* — Larson Newman & Abel, LLP; Chi Suk Kim

(57) ABSTRACT

An ophthalmic blocking pad includes a foam layer, a film layer disposed over and directly contacting the foam layer, and an adhesive layer disposed over the film layer. The film layer has a tensile strength of at least about 25 ksi (172 MPa).

21 Claims, 4 Drawing Sheets

U.S. PATENT DOCUMENTS

| | | | | |
|---|---|---|---|---|
| 6,420,475 | B1 | 7/2002 | Chen | |
| 6,451,398 | B1 * | 9/2002 | Sylvester | 428/41.8 |
| 6,670,417 | B2 | 12/2003 | Foreman et al. | |
| 6,713,552 | B1 | 3/2004 | Lesko et al. | |
| 6,747,084 | B2 | 6/2004 | Gruber et al. | |
| 6,818,271 | B2 * | 11/2004 | Fearn et al. | 428/40.1 |
| 6,867,253 | B1 | 3/2005 | Chen | |
| 6,942,746 | B2 | 9/2005 | Niejelow et al. | |
| 7,067,583 | B2 | 6/2006 | Chen | |
| 7,217,440 | B2 | 5/2007 | Jallouli et al. | |
| 2001/0013668 | A1 | 8/2001 | Neavin et al. | |
| 2001/0031797 | A1 * | 10/2001 | Kuwamura et al. | 521/155 |
| 2002/0013442 | A1 | 1/2002 | Sherman et al. | |
| 2004/0072942 | A1 | 4/2004 | Chen | |
| 2005/0042977 | A1 | 2/2005 | Kawase et al. | |
| 2005/0053747 | A1 | 3/2005 | Yang et al. | |
| 2005/0184619 | A1 | 8/2005 | Chen | |
| 2005/0276965 | A1 * | 12/2005 | Etchells | 428/314.4 |

FOREIGN PATENT DOCUMENTS

| | | | |
|---|---|---|---|
| EP | 1 081 758 | A1 | 3/2001 |
| EP | 1 173 306 | B1 | 9/2003 |
| EP | 1 371 702 | A1 | 12/2003 |
| JP | 2005111612 | A * | 4/2005 |
| WO | 94/02286 | | 2/1994 |
| WO | WO 99/33641 | | 7/1999 |
| WO | WO 00/64631 | | 11/2000 |
| WO | WO 03/003073 | A1 | 1/2003 |
| WO | WO 2005059055 | A2 * | 6/2005 |

OTHER PUBLICATIONS

3M Leap III Finish Blocking Pads, 3M Medical Specialties, Printed in USA 2003, 2006.

Mactac Performance Guide, a Bemis Company, MACfilm IF-2092, Version 2, Jun. 2002.

Mactac Performance Guide, a Bemis Company, MACfilm IF-2095, Version 2, Jun. 2002.

Pilcher Hamilton, PHanex IHC Polyester film, Aug. 1999.

Bond to Non-Stick Surfaces—Silicone PSA—Omnexus 4 Adhesives, Bluestar Silicones, http://www.omnexus4adhesives.com/bc/silicone-PSA/index.aspx?id=bonding, Nov. 6, 2009, 2 pgs.

3M™ Silicone Laminating Adhesive Tapes, Extended shelf life with single liner productivity, www.3M.com/converter, 2 pgs.

3M Pressure Sensitive Adhesive Tapes "Go-to" Selection, 4 pgs, 2007.

3M™ Silicone Laminating Adhesive Tapes, Extended shelf life with single liner productivity, www.3M.com/converter, 2 pgs, 2009.

Wilkinson, Dr. Peter; "Coatings and tints, Part 2: Product availability and choice" Continuing Education and Training; Feb. 24, 2006; 8 pages.

* cited by examiner

OPHTHALMIC BLOCKING PAD

FIELD OF THE DISCLOSURE

This disclosure, in general, relates to ophthalmic blocking pads and methods for their use.

BACKGROUND

Optical lenses are useful in a variety of industries from astronomy to telecommunications to optometry. In particular, a large international industry exists in preparing ophthalmic medical devices, such as glasses and spectacles. Fashion trends and a variety of medical conditions lead to a large variety of frames for glasses and spectacles, each requiring or utilizing a different shaped lens. To simplify the process and to improve the economy of providing lenses having a variety of prescriptions and different shapes conforming to the various frame styles available, laboratories have turned to using a set of stock lens work pieces that can be shaped in accordance with the desired frame shape and ophthalmic prescription.

To shape the stock lens work pieces to fit within a frame, an edger or other shaping machine is used to remove excess lens material and to form a contour with the stock lens work piece that conforms to the frame dimensions. In general, edgers and other shaping machines include a block or mount that secures a lens work piece during the edging or shaping process. Historically, conformable substances, such as low melting metal alloys and polymer compositions, have been used to conform to and secure a lens work piece in place. In other examples, shaping and edging equipment can include a set of blocks, each block of the set of blocks conforming to a particular curvature of an associated lens work piece. In addition, adhesives and adhesive tapes have been used to secure the lens work piece to the block.

More recently, the nature of the lens work pieces has changed with the use of more advanced materials and coatings. In particular, lens work pieces have shifted from traditional glass work pieces to polymeric work pieces, such as polycarbonate. In addition, advances have been made in coating technologies that protect lenses from scratching, prevent glare and reflection, reduce fogging, and limit dirt buildup. In particular, anti-reflection surfaces form low energy surfaces. Such low energy surfaces often are difficult to secure in a machine and, in particular, secure in a shaping or edging device that exerts large torque on the lens work piece.

As such, an improved block mounting pad would be desirable.

SUMMARY

In a particular embodiment, an ophthalmic blocking pad includes a foam layer, a film layer disposed over and directly contacting the foam layer, and an adhesive layer disposed over the film layer. The film layer has a tensile strength of at least about 25 ksi (172 MPa).

In a further embodiment, an ophthalmic blocking pad includes a foam layer having a specific gravity not greater than about 0.6, a rigid film layer in direct contact with the foam layer, and an adhesive layer configured to exhibit a peel adhesion of at least about 4.0 lb/in (0.70 N/mm) on polypropylene. The rigid film layer has a tensile strength of at least about 25 ksi (172 MPa).

In another embodiment, an ophthalmic blocking pad includes a foam layer and an adhesive layer. The ophthalmic blocking pad exhibits a Torque Performance of at least about 17.0 in-lb.

In an additional embodiment, an ophthalmic blocking pad includes a foam layer and an adhesive layer. The ophthalmic blocking pad exhibits a Peel Performance of at least about 1.5 N/cm.

In a further embodiment, a method of preparing an ophthalmic lens includes applying a first surface of a blocking pad to an ophthalmic lens work piece. The blocking pad is configured to exhibit a Torque Performance of at least about 17.0 in-lb and a Peel Performance of at least about 1.5 N/cm. The method further includes applying a second surface of the blocking pad to a machine block and shaping the ophthalmic lens work piece to form a shaped ophthalmic lens.

In another embodiment, an ophthalmic blocking article includes a first release liner forming a continuous sheet and a plurality of ophthalmic blocking structures disposed on the first release liner. Each ophthalmic blocking structure of the plurality of blocking structures includes a first adhesive layer in contact with the first release liner, a foam layer disposed over the first adhesive layer, a second adhesive layer disposed over the foam layer, and a rigid film layer disposed between at least one of the first and second adhesive layers and the foam layer.

DESCRIPTION OF THE DRAWINGS

In a particular embodiment, an ophthalmic blocking pad includes a foam layer, a film layer disposed over the foam layer, and an adhesive layer disposed over the film layer. The film layer may have a tensile strength greater than that of the foam layer, such as a tensile strength of at least about 25 ksi (172 MPa). In a particular example, the foam layer is a low density microcellular foam having a specific gravity not greater than 0.8. The adhesive layer may include an adhesive configured to bond to a low surface energy material, such as a modified acrylic pressure sensitive adhesive. The ophthalmic blocking pad also may include a second adhesive layer.

In a further exemplary embodiment, a method of preparing an ophthalmic device includes applying a first surface of a blocking pad to a lens work piece, applying a second surface of the blocking pad to a block, and shaping the lens work piece. The blocking pad may have a Peel Performance of at least about 1.0 N/cm and a Torque Performance of at least about 17.0 in-lb.

Figure 1:
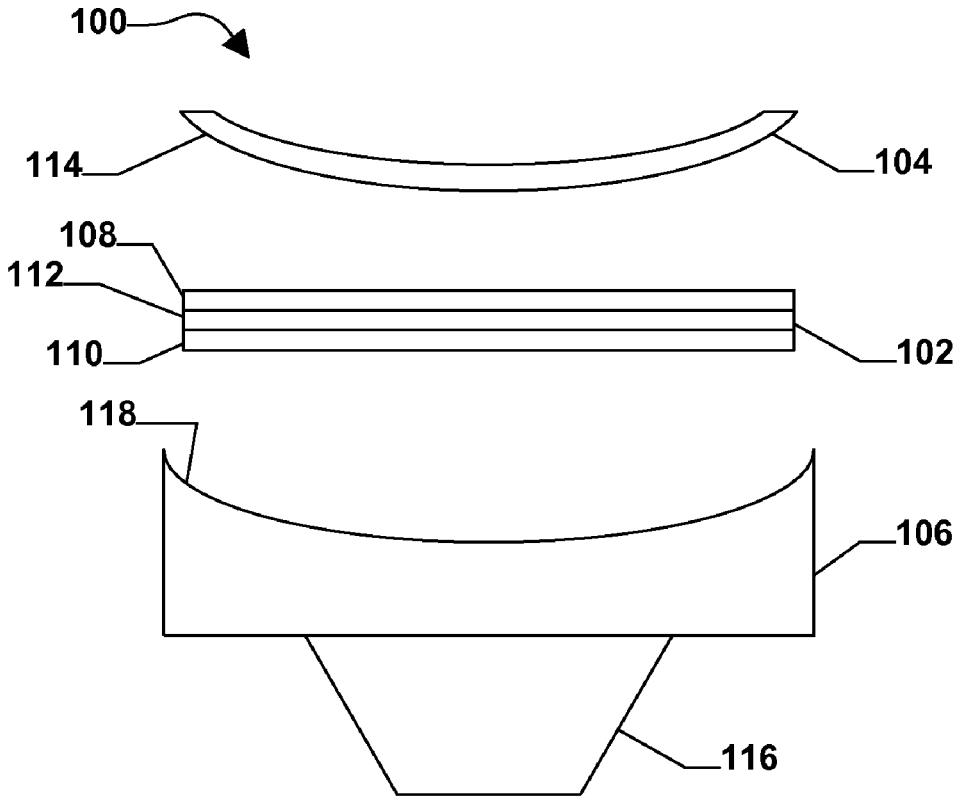
FIG. 1 and FIG. 2 include illustrations of an exemplary embodiment of a blocking system.
Figure 2:
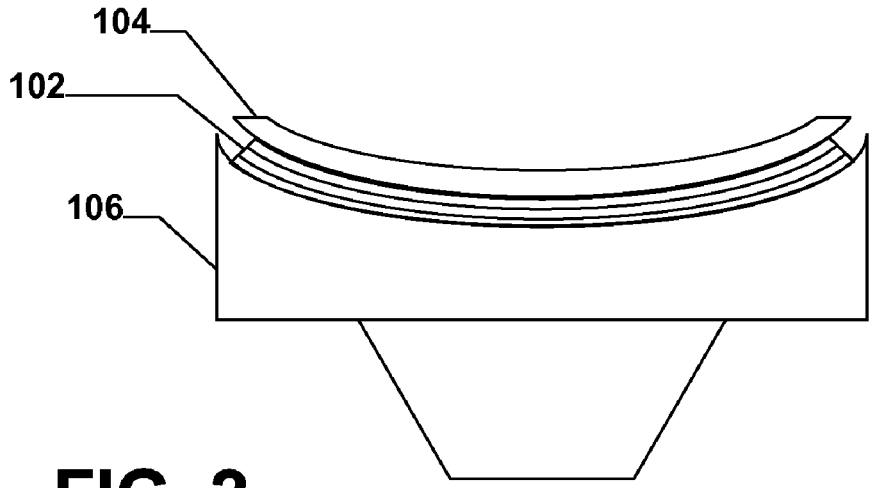

As illustrated in FIG. 1 and FIG. 2, a lens shaping system may include a blocking pad 102 and a block 106. Typically, the blocking pad 102 includes a first adhesive surface 108 and a second adhesive surface 110 surrounding a foam layer 112. In an example, the adhesive surface 108 is applied to a surface 114 of a lens work piece 104. In addition, the adhesive surface 110 is applied to a surface 118 of the block 106. As a result, the lens 104 is adhered to the block 106, as illustrated at FIG. 2.

In addition, the block 106 may include an engagement mechanism 116 for securing the block assembly within a shaping device. While a single blocking assembly is illustrated at FIG. 2, more than one blocking assembly may be used to secure the lens work piece 104 to a shaping device. For example, a second blocking assembly may secure a second surface of the lens work piece 104.

The block 106 may include a conformable material, such a low melt metal alloy or polymer composition. Alternatively, the block 106 may be a solid block having a rigid radius of curvature or shape. In a further example, the block 106 may include a flexible surface 118 that adjusts to the radius of curvature of the lens work piece 104. In an alternative embodiment, the blocking pad 102 may include a single adhesive surface 108 and surface 118 may be configured to bond with a conformable material, such as a metal alloy or polymer composition. In additional embodiments, the surface 110 may be configured to adhere with the block 106 through electrostatic or other forces.

Figure 3:
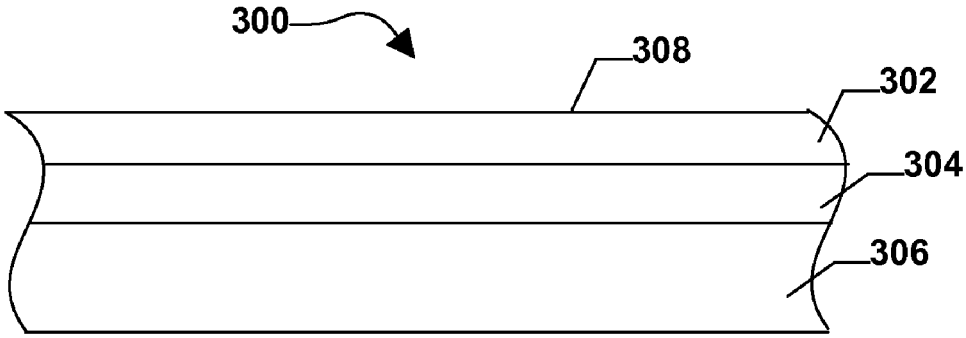
FIG. 3 and FIG. 4 include illustrations of exemplary embodiments of blocking pads.

FIG. 3 includes an illustration of an exemplary embodiment of a blocking pad 300. The blocking pad 300 includes an adhesive layer 302 overlying a film layer 304. The film layer 304 overlies and directly contacts a foam layer 306. In an exemplary embodiment, the film layer 304 is adhered directly to and directly contacts the foam layer 306 absent an intervening adhesive. In a further exemplary embodiment, the adhesive layer 302 directly contacts the film layer 304. In general, the adhesive layer 302 forms a surface 308 configured to adhere to a lens work piece. In an additional embodiment, an optional release liner may overlie the adhesive layer 302 of the blocking pad 300 during transport and prior to use.

In an exemplary embodiment, the adhesive layer 302 includes an adhesive configured to bond to a surface of an ophthalmic lens work piece. In particular, the adhesive may be configured to bond to a low energy surface material, such as a specialized coating on a lens work piece. For example, the adhesive may be a pressure sensitive adhesive, such as a silicone rubber, synthetic rubber, acrylic adhesive, or any co-polymer, alloy or combination thereof. In a particular example, the adhesive is a pressure sensitive synthetic rubber adhesive. In a further exemplary embodiment, the adhesive is a modified acrylic adhesive, such as tackified modified acrylic adhesive. For example, the acrylic may be a pressure sensitive acrylic hybrid configured to bond to low surface energy surfaces. In another example, the adhesive may be a silicone adhesive.

In particular, the adhesive of the adhesive layer 302 exhibits a desirable peel adhesion to polymeric surfaces. In an example, the adhesive may exhibit a peel adhesion of at least about 4.0 lb/in (0.70 N/mm) on polypropylene. For example, the adhesive may exhibit a peel adhesion of at least about 5.0 lb/in (0.88 N/mm) on polypropylene, such as at least about 5.25 lb/in (0.92 N/mm) on polypropylene. Further, the adhesive may exhibit a peel adhesion of at least about 4.0 lb/in (0.70 N/mm) on high-density polyethylene. In particular, the adhesive may exhibit a peeled adhesion of at least about 4.0 lb/in (0.70 N/mm) on each of polypropylene, high-density polyethylene, and low-density polyethylene.

In an exemplary embodiment, the adhesive layer has a thickness in a range between about 0.1 mil (2.5 micron) and 5.0 mil (127 micron). In particular, the thickness may be in a range between about 2.5 mil (63.5 micron) and 4.5 mil (114 micron), such as a range of about 3.0 mil (76.2 micron) to about 4.0 mil (102 micron).

The film layer 304, for example, may include a polymeric material having a greater tensile strength and modulus than the foam layer 306. For example, the film layer 304 may include a polymeric sheet material, such as a polyester, polyaramide, polyolefin, polyamide, polycarbonate, polysulfone, polytetrafluoroethylene, polyurethane, poly vinyl acetate, poly vinyl alcohol, poly vinyl chloride, poly vinylidene chloride, poly vinylidene fluoride, copolymers or alloys thereof, or any combination thereof. In an example, the film layer 304 is formed of a polyester film, such as PHanex™ IHC polyester film, available from Pilcher Hamilton Corporation.

In a particular example, the film layer 304 has a tensile strength of at least about 25 ksi (172 MPa), such as at least about 30 ksi (206 MPa). In addition, the film layer may have an elongation-at-break not greater than about 150%, such as an elongation-at-break of not greater than about 110%, or even as low as 100%. In addition, the film layer 304 may have a tensile modulus of at least about 400 ksi (2.76 GPa), such as at least about 500 ksi (3.44 GPa), or even at least about 550 ksi (3.76 GPa).

In an exemplary embodiment, the film layer has a thickness in a range between about 0.1 mil (2.5 micron) and 5.0 mil (127 micron). For example, the thickness may be in a range between about 1.5 mil (38.1 micron) and 2.5 mil (63.5 micron), such as approximately 2.0 mil (51 micron).

In a particular embodiment, the film layer 304 is in direct contact with a foam layer 306. The foam layer 306, for example, may be formed of a low density polymer foam, such as a micro-cellular foam. The foam layer 306 may be formed of polyurethane, silicone, polyester, expandable polyolefin, polyether, diene elastomer, copolymers or alloys thereof, or any combination thereof. In a particular example, the foam layer 306 is formed of a polyurethane foam.

The foam layer 306 may have a specific gravity not greater than about 0.8. For example, the foam layer may have a specific gravity not greater than about 0.7, or even, not greater than 0.6. In particular, the foam layer 306 may have a density of about 25 lb/ft$^3$ (0.40 g/cc) to about 40 lb/ft$^3$ (0.64 g/cc), such as about 27 lb/ft$^3$ (0.43 g/cc) to about 35 lb/ft$^3$ (0.56 g/cc). In addition, the foam layer 306 may exhibit a tensile strength less than that of the film layer 304. For example, the tensile strength of the foam layer 306 may be not greater than about 10 ksi (69 MPa), such as not greater than about 5 ksi (34 MPa), or even not greater than about 1 ksi (6.9 MPa). Further, the foam layer 306 may have an elongation-at-break greater than that of the film layer 304. For example, a foam layer 306 may have an elongation-at-break of at least about 200%, such as at least about 300%, or even, greater than about 400%. Further, the foam layer 306 may have a desirable 100% modulus of at least about 140 psi (965 kPa). In addition, the foam layer 306 may exhibit a force-to-compression of about 10 psi (69 kPa) to about 20 psi (137 kPa), such as about 15 psi (103 kPa) to about 20 psi (137 kPa). Force-to-compression may be determined in accordance with ASTM D3574, Test C with a shear of 2%.

Typically, the foam layer 306 has a thickness in a range between about 20 mil (0.51 mm) and 40 mil (1.0 mm). For example, the thickness of the foam layer 306 may be between about 25 mil (0.64 mm) and 37 mil (0.94 mm). In particular, a ratio of the foam layer 306 thickness to the film layer 304 thickness is in a range between about 5 and about 20, such as a range between about 8 and about 19.

While not illustrated, the blocking pad 300 may include an additional adhesive layer, forming an adhesive surface opposite the surface of 308. For example, the additional adhesive layer may be located on an opposite side of the foam layer 306 from the adhesive layer 302. Further, an additional film layer may be disposed between the additional adhesive layer and the foam layer 306.

Figure 4:
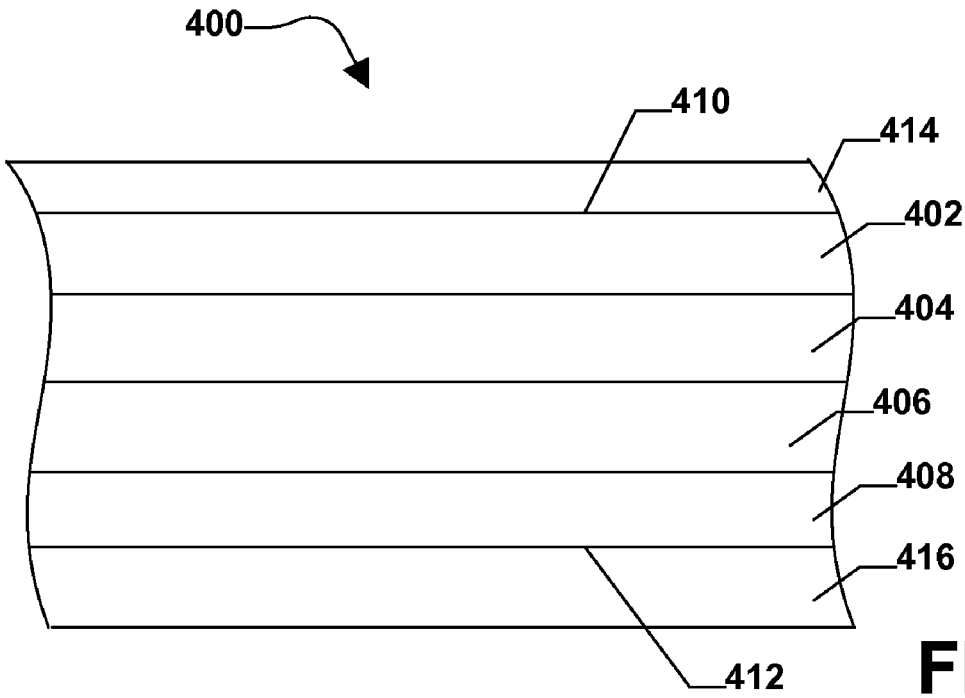

FIG. 4 includes a further embodiment of a blocking pad 400. For example, the blocking pad 400 includes a foam layer 406. A film layer 404 may be in direct contact with and disposed over a major surface of the foam layer 406. An adhesive layer 402 may be disposed over the film layer 404 and may be in direct contact with the film layer 404. In addition, the blocking pad 400 may include an adhesive layer 408 disposed over a major surface of the foam layer 406 opposite the major surface over which the film layer 404 and adhesive layer 402 are disposed. Optionally, a film layer (not illustrated) may be disposed between the adhesive layer 408 and the foam layer 406. Alternatively, the adhesive layer 408 may be in direct contact with the foam layer 406.

The adhesive layers 402 and 408 may be formed of similar adhesives. Alternatively, the adhesive layer 402 may be formed of a different adhesive from the adhesive layer 408. In a particular example, the adhesive layers 402 and 408 are pressure sensitive adhesives. Alternatively, the adhesive layer 402 may be a pressure sensitive adhesive and the adhesive layer 408 may be an adhesive activated by other methods, such as a thermally activated adhesive or a radiation activated adhesive, for example, a UV activated adhesive. In particular, the adhesive layer 402 includes an adhesive configured to bond with a low-surface energy material. The adhesive of adhesive layer 408 may be configured to bond with a blocking material, such as a metal or an elastomeric polymer.

In particular, the adhesive layer 402 may be configured to form an adhesive surface 410 configured to bond to a lens work piece. The adhesive layer 408 may include an adhesive surface 412 configured to bond with a block or blocking material associated with a shaping device, such as an edging device.

In addition, the blocking pad 400 may include release liners 414 and 416. In particular, the release liners 414 and 416 may be configured to protect the adhesive surfaces 410 and 412 during transport and prior to use. For example, the release liners 414 and 416 may be formed of very low surface energy films, polymer coated papers, oil-infused papers or fabrics, or other releasable materials. In particular, the release liner 414 or 416 may be formed of a silicon oil-infused paper or fabric. In another exemplary embodiment, the release liner 414 or 416 may be formed of a silicone film.

Figure 5:
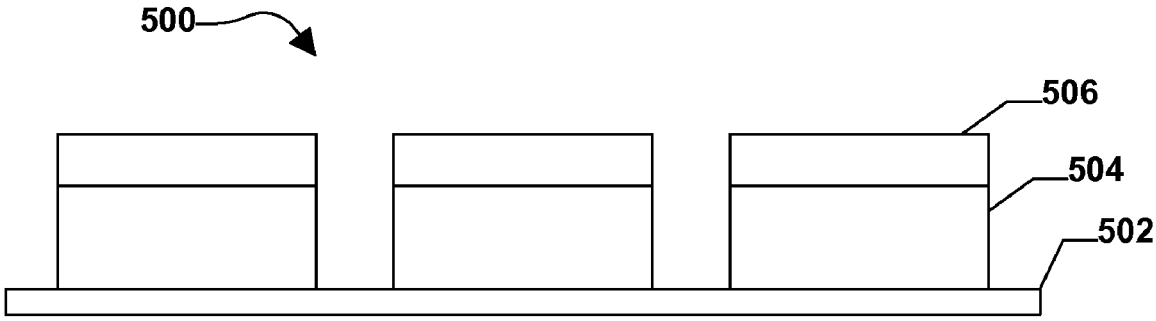
FIG. 5 includes an illustration of an exemplary bandoleer including exemplary blocking pads.

In a particular embodiment illustrated in FIG. 5, a set of blocking pads may be formed as a bandoleer. For example, a release liner 502 may form a continuous sheet over which blocking pads 504 are situated. A second release liner 506 may conform to the contour of the blocking pads 504. Optionally, the second release liner 506 may include a tab (not illustrated) to facilitated removal of the second release liner 506 from the blocking pad 504.

In general, the blocking pad 504 may have a 3, 4 or 5 layer structure, as described above. In particular, the blocking pad 504 includes at least one adhesive layer disposed over a film layer that is disposed over a foam layer. In addition, the blocking pad 504 may include a second adhesive layer. Each of the blocking pads 504 may be cut or shaped to a desired configuration such that when the blocking pad 504 is removed from the release liner 502 it is configured for use with a lens work piece. Alternatively, the release liner 502 may be perforated and configured to tear to permit removal of a release liner 502 and at least one blocking pad 504 for use.

Figure 6:
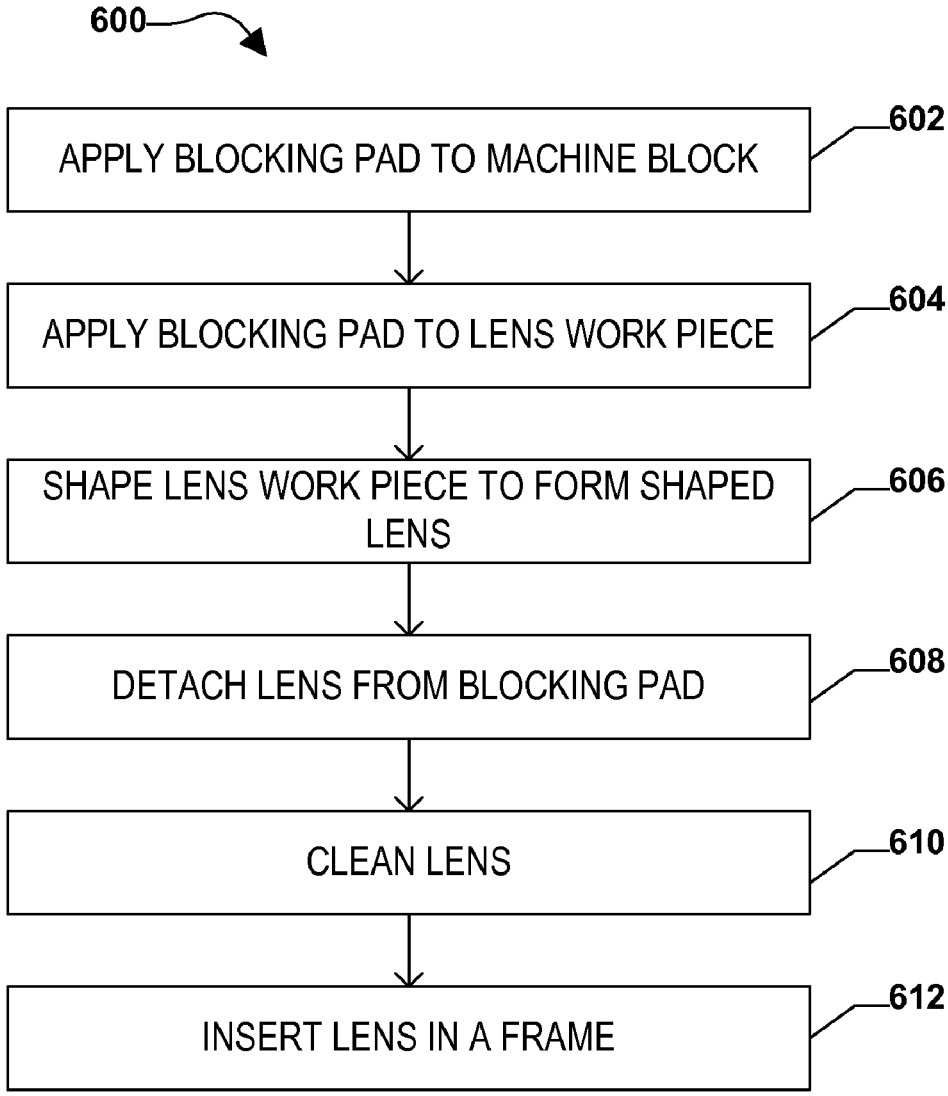
FIG. 6 includes a flow diagram illustration of an exemplary method for preparing an ophthalmic device.

When in use, the blocking pad is used to adhere a lens work piece to a block configured for use in machining or shaping the lens work piece. For example, FIG. 6 includes an illustration of an exemplary method 600 for forming an ophthalmic device, such as a pair of glasses or spectacles. The blocking pad may be applied to a machine block or machine component, as illustrated at 602. The blocking pad may act to adhere a lens work piece to the machine block. For example, a machine block that includes a rigid surface or an elastomeric surface may be configured to receive a lens work piece. The blocking pad may include a first adhesive surface configured to adhere to the material forming the machine block.

In addition, the blocking pad may be applied to a lens work piece, as illustrated at 604. In particular, a second adhesive surface may be applied to a surface of a lens work piece. The second adhesive surface may be configured to adhere to a low surface energy material, such as a coating on the lens work piece.

Once the assembly including the machine block, the blocking pad, and the lens is prepared, the assembly may be placed in a shaping machine to shape the contour of the lens to conform to the ophthalmic device, such as the frames of a set of glasses, in which the lens is to be placed, as illustrated at 606. Once the lens work piece has been shaped and formed into a lens, the lens may be removed or detached from the block by detaching the lens from the blocking pad, or detaching the blocking pad from the block, as illustrate at 608. In particular, the blocking pad may be peeled from the lens, providing a shaped lens.

The shaped lens subsequently may be cleaned, as illustrated at 610, and inserted into frames, as illustrated at 612. As such, an ophthalmic device, such as glasses or spectacles may be formed using the blocking pad.

Figure 7:
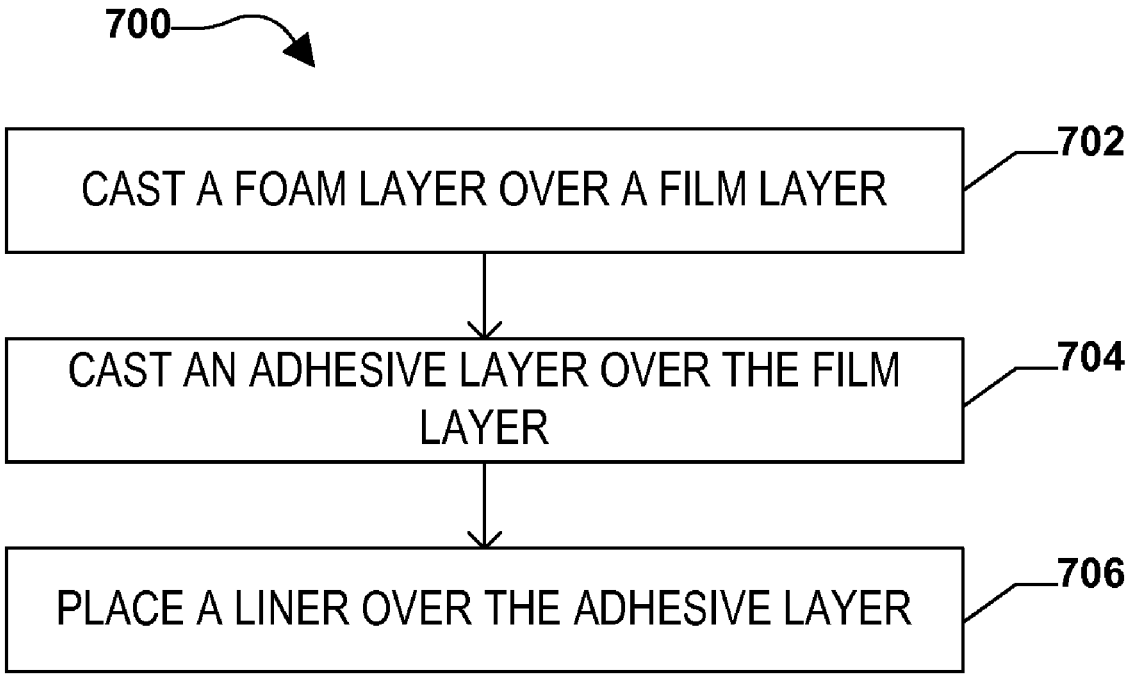
FIG. 7 includes a flow diagram illustration of an exemplary method for forming a blocking pad.

In a particular embodiment, the blocking pad may be formed by casting or laminating layers together. In an exemplary embodiment illustrated in FIG. 7, the method 700 includes casting adhesive layers and foam layers over a film layer. For example, a foam layer may be cast over a film layer, such as a polyethylene terephthalate film layer, as illustrated at 702. In a particular example, the foam layer may be a polyurethane foam. In addition, an adhesive layer, such as a modified acrylic adhesive layer, may be cast over an opposite surface of the film layer, as illustrated at 704. Further, an adhesive layer may be cast over the foam layer on a surface opposite from the film layer. In addition, release liners may be applied to the surface of the adhesive layers, as illustrated at 706.

In another embodiment, the foam layer may be formed over a film layer, such as through knife over roll direct casting. The adhesive layer may be cast over a liner and partially cured. For example, the adhesive layer may be cast, such as through knife over roll direct casting, onto a preformed liner and heat-treated. In an example, the adhesive is coated on a release liner and heated in one or more ovens having temperature zones (120° F., 140° F., 220° F., 225° F., 225° F.) at 20 ft/min (0.10 m/s) with a total oven length of 75 feet (23 m). The adhesive layer may be laminated to the foam layer or the film layer.

In an exemplary embodiment, the blocking pad adheres to a lens or a lens work piece sufficiently to provide desirable properties, such as securing the lens work piece during an edging operation. In particular, the blocking pad may be configured to provide a desired Peel Performance, Torque Performance, and Displacement Slope, as further defined below in the Example section. Peel Performance is the peel strength exhibited when the blocking pad is adhered to an anti-reflective lens, and is desirable within a range of about 0.95 N/cm to about 2.5 N/cm. In particular, the ophthalmic blocking pad may exhibit a Peel Performance of at least about 1.0 N/cm, such as at least about 1.3 N/cm, or even at least about 1.5 N/cm. Torque Performance is the maximum torque before failure of a blocking pad on an anti-reflective lens and is desirably high. For example, the blocking pad may provide a Torque Performance of at least about 17.0 in-lb. In a particular example, the Torque Performance may be at least about 20 in-lb, such as at least about 22 in-lb. Displacement Slope is the initial ratio of torque to deflection, and is desirably at least about 0.95, such as in a range of about 0.95 to about 1.2, such as about 1.0 to about 1.15. As used herein, Displacement Slope has units of in-lb/degree unless otherwise specified.

EXAMPLES

Example 1

A set of blocking pads is formed. Each blocking pad includes adhesive layers on both external major surfaces and a foam core layer. The foam core layer is a microcellular polyurethane foam having a specific gravity of approximately 0.48 to approximately 0.58. The thickness of the foam core layer is approximately 25 mil (0.64 mm) to approximately 31 mil (0.78 mm). The adhesive layers have a thickness of approximately 3 mil (76 micron) to approximately 4 mil (101 micron) and are formed of an acrylic pressure sensitive adhesive configured to bond to low surface energy surfaces. In addition, the blocking pad may include a film layer having a thickness of approximately 2 mil (51 micron) to approximately 5 mil (127 micron). The film layer is formed of a PHanex® IHC polyester film, available from Pilcher Hamilton Corporation. A sample is also formed that does not include the film layer.

When the blocking pad includes a film layer, the polyurethane foam layer is formed on the film by knife over roll direct cast. The adhesive is partially cured, 5 minutes at room temperature, 5 minutes at 250° F., and 5 minutes at 300° F., and laminated to the film or foam layers.

Example 2

Comparative testing of the blocking pads of Example 1 is performed to determine peel strength and torque values for standard and anti-reflective lenses. Comparative samples include samples of OP7™and OP5C™ pad, available from D.A.C. Vision of Dallas, Tex., samples of Leap 2™, Leap 3∩, 3M LSE™, and 411DL™ pads, available from 3M, and samples of BluEdge® pads.

Maximum Continuous 90° Peel Strength is measured for each sample on both a standard lens, Airwear™ scratch resistant lens available from Essilor™ (a lens including an oleophobic and hydrophobic coating formed from fluorinated silazane). Peel strength is determined using an Intron™ with a setting of 12 in/min (0.51 cm/s). The blocking pads are attached to the film and permitted to sit for 5 minutes before testing.

As illustrated in TABLE 1, the sample films performed comparably to other commercially available films when tested for peel strength on a standard lens. While the OP5C™ and 3M LSE™ pads performed well, many of the samples and comparative samples exhibit a peel strength on standard lenses of between approximately 3 N/cm to approximately 4 N/cm. However, when the samples and comparative samples are tested for peel strength on anti-reflective lenses, Samples 1, 2, and 3 exhibit significantly greater peel strengths than many of the comparative samples.

Peel Performance is defined as the maximum continuous 90°peel strength for a pad tested on an Essilor® Airwear® Crizal® Alize®anti-reflective lens (a lens including an oleophobic and hydrophobic coating formed from fluorinated silazane). With the exception of 3M LSE™ pads, each of the comparative samples exhibits a Peel Performance of less than 1.0 N/cm.

TABLE 1

Maximum Continuous 90° Peel for Various Samples

| Sample | Max. Continuous 90° Peel (N/cm) Standard Lens | Anti-Reflective Lens |
|---|---|---|
| OP7™ | 3.26 | 0.68 |
| OP5C™ | 5.17 | 0.97 |
| Sample 1 (no PET film) | 3.41 | 1.92 |
| Sample 2 (2 mil PET film) | 3.85 | 1.74 |
| Sample 3 (5 mil PET film) | 3.13 | 1.15 |
| Leap 3™ | 3.49 | 0.52 |
| 3M LSE™ | 7.94 | 1.21 |
| BluEdge® | 3.32 | 0.67 |

Torque Performance is defined as the maximum torque at failure for a blocking pad on an Essilor® Airwear® Crizal® Alize® anti-reflective lens (a lens including an oleophobic and hydrophobic coating formed from fluorinated silazane). Torque Performance is determined using a Falex Torque Testing Machine configured to apply torque to the blocking pad at a rate of 1 rpm with a 3 lb load on the sample blocking pad. The blocking pad is bonded to the lens and allowed to sit for 1 minute. The failure of the pad typically occurs within 2 to 5 seconds. Displacement Slope is determined based on the initial ratio of torque to displacement using the method above.

As illustrated in TABLE 2, the Samples 1, 2, and 3 exhibit a high Torque Performance (>20 in-lb) relative to other commercially available blocking pads. In particular, Sample 2 exhibits a Torque Performance at least about 10% greater than the Torque Performance of Samples 1 and 3.

In another example, performance of a sample can be characterized by Displacement Slope, defined as the initial ratio of torque to displacement when tested on an Essilor® Airwear® Crizal® Alize® anti-reflective lens (a lens including an oleophobic and hydrophobic coating formed from fluorinated silazane). As illustrated in Table 2, Samples 1, 2, and 3 exhibit a desirable Displacement Slope of approximately 1.0.

TABLE 2

Torque Performance

| Sample | Torque Performance (in-lb) | Displacement Slope (in-lb/degree) |
|---|---|---|
| OP7™ | 15 | 0.8 |
| OP5C™ | 16 | 0.5 |
| Sample 1 (no PET film) | 20.3 | 0.82 |
| Sample 2 (2 mil PET film) | 22.8 | 1.1 |
| Sample 3 (5 mil PET film) | 20.7 | 0.96 |
| Leap 2™ (3M) | 13.3 | 0.9 |
| Leap 3™ (3M) | 15.4 | 0.9 |
| 3M LSE™ | 16.8 | 0.74 |
| 411DL™ (3M) | 13.2 | 0.58 |
| BluEdge® | 13.4 | 0.5 |

Example 3

Foam properties are varied to study the influence of foam properties on ophthalmic blocking pad performance. In particular, foam layer thickness, foam layer density, and foam composition/processing are varied. Changes in the foam composition and processing result in different foam density and force-to-compress. In particular, the various foam densities are achieved with changes in Nitrogen gas flow rates during processing, effecting the density of the frothed foam polyurethane. Force-to-compress is determined in accordance with ASTM D3574, Test C with a shear of 2%. Samples are compared to a low force-to-compress foam, V2800 polyurethane available from Saint-Gobain Performance Plastics Corporation.

TABLE 3 relates foam properties to Torque Performance. While each of the Samples 4-8 performed better than the comparative samples illustrated above, several ophthalmic blocking pad samples having a thickness of about 31 to about 39 exhibit Torque Performance of greater than about 20 in-lb. In another example, several samples having a foam layer density of about 27 lb/ft$^3$ (0.43 g/cc) to about 36 lb/ft$^3$ (0.58 g/cc), and in particular, samples having a foam layer density of about 34 lb/ft$^3$ (0.54 g/cc) to about 35 lb/ft$^3$ (0.56 g/cc) appear to exhibit a Torque Performance of at least about 21 in-lb. In a further example, several samples having a force-to-compression of about 10 psi (69 kPa) to about 20 psi (138 kPa) exhibit a desirable Torque Performance. In contrast, the V2800 foam, having a force-to-compress of about 3.3 psi (23 kPa), exhibits a poor Torque Performance.

TABLE 3

Torque Performance of Samples Having Different Foam Layer Compositions

| Sample | Foam Layer Thickness (mil) | Foam Layer Density (lb/ft$^3$) | Foam Layer Force-to-Compress (psi) | Torque Performance (in-lb) |
|---|---|---|---|---|
| Sample 4 | 31 | 34.1 | 10.1 | 21.4 |
| Sample 5 | 32 | 30.6 | 16.6 | 17.8 |
| Sample 6 | 37 | 34.3 | 16.5 | 22.2 |
| Sample 7 | 39 | 28.7 | 17.5 | 20.5 |
| Sample 8 | 40 | 48.2 | 29.5 | 18.2 |
| V2800 | 30 | 35.0 | 3.3 | 15.9 |

Example 4

Peel Performance, Torque Performance, and Displacement Slope are determined for samples having varying thickness of film and adhesive layers. The samples are formed as described in Example 1 with the exception of the selection of different layer thicknesses.

As illustrated in Table 4, samples including a film layer of at least 2 mil and an adhesive layer of at least about 3 mil (76 micron) exhibit high Torque Performance, Displacement Slope, and Peel Performance. In particular, Samples including a film layer of approximately 2 mil (51 micron) and an adhesive layer of approximately 2-3 mil (51-76 micron) exhibit a desirable Displacement Slope of approximately 1.0, a desirable Peel Performance of approximately 1.0 N/cm, and a Torque Performance greater than 22.0 in-lb.

TABLE 4

Sample Performance

| Film Thickness (mil) | Adhesive Thickness (mil) | Torque Performance (in-lb) | Displacement Slope (in-lb/degree) | Peel Performance (N/cm) |
|---|---|---|---|---|
| 0 | 2 | 18.3 | 0.79 | 1.68 |
| 0 | 3 | 20.3 | 0.82 | 1.92 |
| 0 | 4 | 20.2 | 0.67 | 2.40 |

TABLE 4-continued

Sample Performance

| Film Thickness (mil) | Adhesive Thickness (mil) | Torque Performance (in-lb) | Displacement Slope (in-lb/degree) | Peel Performance (N/cm) |
|---|---|---|---|---|
| 2 | 2 | 22.4 | 0.98 | 1.01 |
| 2 | 3 | 22.8 | 1.10 | 1.74 |
| 2 | 4 | 23.4 | 1.00 | 1.66 |
| 5 | 2 | 17.7 | 0.91 | 0.72 |
| 5 | 3 | 20.7 | 0.96 | 1.16 |
| 5 | 4 | 22.4 | 1.15 | 1.79 |

Example 5

A blocking pad is formed including adhesive layers on both external major surfaces and a foam core layer. The foam core layer is a microcellular polyurethane foam having a specific gravity of approximately 0.48 to approximately 0.58. The thickness of the foam core layer is approximately 30 mil (0.76 mm). The adhesive layer has a thickness of approximately 3 mil (76 micron) and is formed of a silicone adhesive configured to bond to low surface energy surfaces. In addition, the blocking pad includes a film layer having a thickness of approximately 2 mil (51 micron). The film layer is formed of a PHanex® IHC polyester film, available from Pilcher Hamilton Corporation.

The blocking pad having silicone adhesive surfaces exhibits a Torque Performance of 24 in-lb and a Displacement Slope of 0.83. As such, the blocking pad exhibits a desirable combination of Torque Performance and Displacement Slope.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What sis claimed is:

1. An ophthalmic blocking pad comprising:

a foam layer having a density of 25 lb/ft$^3$ to 40 lb/ft$^3$, a film layer disposed over and directly contacting the foam layer, the film layer having a tensile strength of at least about 25 ksi (172 MPa); and an adhesive layer disposed over the film layer, wherein the adhesive layer exhibits a peel adhesion of at least 4.0 lb/in (0.70 N/mm) on polyethylene;

wherein the ophthalmic blocking pad has a torque performance of at least 20 in-lb.

2. The ophthalmic blocking pad of claim 1, wherein the adhesive layer includes an adhesive configured to bond to a low surface energy material.

3. The ophthalmic blocking pad of claim 2, wherein the adhesive exhibits a peel adhesion of at least about 4.0 lb/in (0.70 N/mm) on polypropylene.

4. The ophthalmic blocking pad of claim 1, further comprising a release liner disposed over the adhesive layer.

5. The ophthalmic blocking pad of claim 1, further comprising a second film layer disposed over a major surface of the foam layer opposite the film layer.

6. The ophthalmic blocking pad of claim 1, further comprising a second adhesive layer disposed over an opposite major surface of the foam layer from the adhesive layer.

7. The ophthalmic blocking pad of claim 1, wherein the film layer has an elongation-at-break of not greater than about 150%.

8. The ophthalmic blocking pad of claim 1, wherein the foam layer has a tensile strength of not greater than about 10 ksi (68 MPa).

9. The ophthalmic blocking pad of claim 1, wherein the foam layer has an elongation-at-break of at least about 200%.

10. The ophthalmic blocking pad of claim 1, wherein the foam layer has a thickness in a range between about 20 mil (0.51 mm) and about 40 mil (1.0 mm).

11. The ophthalmic blocking pad of claim 1, wherein the film layer has a thickness in a range between about 0.1 mil (2.5 micron) and about 5.0mil (127 micron).

12. The ophthalmic blocking pad of claim 1, wherein the adhesive layer has a thickness in a range between about 0.1 mil (2.5 micron) and about 5.0 mil (127 micron).

13. The ophthalmic blocking pad of claim 1, wherein the foam layer comprises polyurethane.

14. The ophthalmic blocking pad of claim 1, wherein the film layer comprises polyester.

15. The ophthalmic blocking pad of claim 1, wherein the adhesive layer comprises an adhesive selected from the group consisting of a silicone, an acrylic, a synthetic rubber, a natural rubber, and a copolymer, alloy, and combination thereof.

16. The ophthalmic blocking pad of claim 15, wherein the adhesive layer comprises an acrylic hybrid.

17. The ophthalmic blocking pad of claim 1, wherein the ophthalmic blocking pad exhibits a peel performance of at least about 1.0 N/cm.

18. The ophthalmic blocking pad of claim 1, wherein the ophthalmic blocking pad exhibits a displacement slope of at least about 0.95 in-lb/degree.

19. An ophthalmic blocking pad comprising:

a foam layer having a density in a range of 25 lb/ft$^3$ to 40 lb/ft$^3$;

a film layer in direct contact with the foam layer, the film layer having a tensile strength of at least about 25 ksi (172 MPa); and an adhesive layer configured to exhibit a peel adhesion of at least about 4.0 lb/in (0.70 N/mm) on polypropylene;

wherein the ophthalmic blocking pad has a torque performance of at least 22 in-lb.

20. An ophthalmic blocking article comprising:

a first release liner forming a continuous sheet; and a plurality of ophthalmic blocking structures disposed on the first release liner, each ophthalmic blocking structure of the plurality of blocking structures comprising:

a first adhesive layer in contact with the first release liner;

a foam layer disposed over the first adhesive layer, the foam layer having a density in a range of 25 lb/ft$^3$ to 40 lb/ft$^3$;

a second adhesive layer disposed over the foam layer; and a film layer disposed between at least one of the first and second adhesive layers and the foam layer and directly contacting the foam layer, the film layer having a tensile strength of at least about 25 ksi (172 MPa);

wherein at least one of the first or second adhesive layers exhibits a peel adhesion of at least 4.0 lb/in (0.70 N/mm) on polyethylene;

wherein each ophthalmic blocking structure has a torque performance of at least 20 in-lb.

21. The ophthalmic blocking article of claim 20, further comprising a second release liner in contact with the second adhesive layer.

* * * * *